US008707505B2

(12) United States Patent
Maranghi et al.

(10) Patent No.: US 8,707,505 B2
(45) Date of Patent: Apr. 29, 2014

(54) CLEANING DEVICE COMPRISING A STRIP MOP WITH STRIPS COVERED WITH MICROFIBER FOR CLEANING FLOORS

(76) Inventors: Marco Maranghi, Prato (IT); Paolo Parenti, Comeana (IT)

( * ) Notice: Subject to any disclaimer, the term of this patent is extended or adjusted under 35 U.S.C. 154(b) by 0 days.

(21) Appl. No.: 13/011,045

(22) Filed: Jan. 21, 2011

(65) Prior Publication Data

US 2011/0173767 A1 Jul. 21, 2011

(30) Foreign Application Priority Data

Jan. 21, 2010 (IT) ..... MI2010A0065

(51) Int. Cl.
*A47L 13/20* (2006.01)

(52) U.S. Cl.
USPC ..... 15/229.1; 15/229.2; 15/244.1

(58) Field of Classification Search
USPC ..... 15/229.1, 229.2
IPC ..... A47L 13/20
See application file for complete search history.

(56) References Cited

U.S. PATENT DOCUMENTS

| | | | | |
|---|---|---|---|---|
| 4,288,884 | A * | 9/1981 | Bahls | 15/244.1 |
| 6,253,408 | B1 * | 7/2001 | Feld et al. | 15/229.2 |
| 7,624,468 | B2 * | 12/2009 | Reddy et al. | 15/104.94 |
| 2008/0016640 | A1 * | 1/2008 | Reddy et al. | 15/228 |

FOREIGN PATENT DOCUMENTS

| | | | |
|---|---|---|---|
| DE | 19833553 | C1 | 12/1999 |
| WO | 2007101518 | A1 | 9/2007 |
| WO | WO2007101518 | * | 9/2007 |
| WO | WO 2007101518 | A1 * | 9/2007 |

OTHER PUBLICATIONS

Italian Search Report, dated Aug. 19, 2010, from corresponding Italian application.

* cited by examiner

*Primary Examiner* — Monica Carter
*Assistant Examiner* — Stephanie Berry
(74) *Attorney, Agent, or Firm* — Young & Thompson

(57) ABSTRACT

A cleaning device connectable to a handle includes a head (100) with a substantially circular profile formed by a plurality (200) of flexible strips in non-woven fabric overlapped and arranged to cover the circumference of the head (100) wherein the outermost strips (1) of the plurality of overlapped strips (200) have the outer surface formed by a microfiber layer (8) supported by a non-woven fabric layer (9), and the innermost strips (3) have a greater stiffness than the remaining strips.

21 Claims, 2 Drawing Sheets

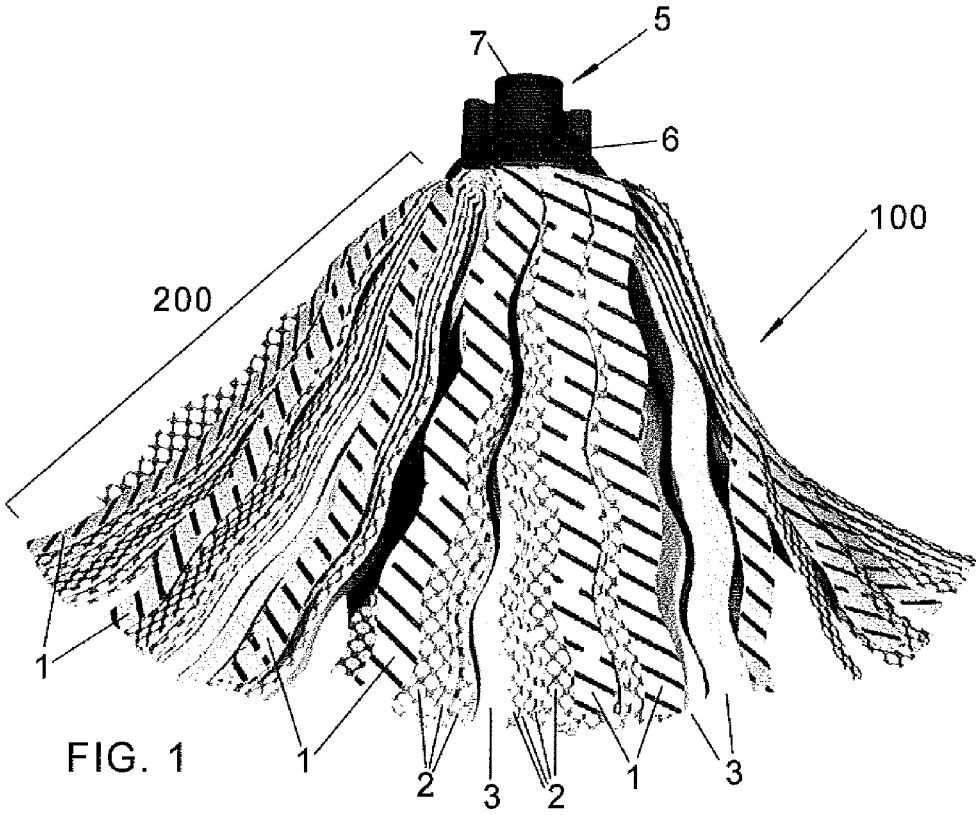
FIG. 1
FIG. 2
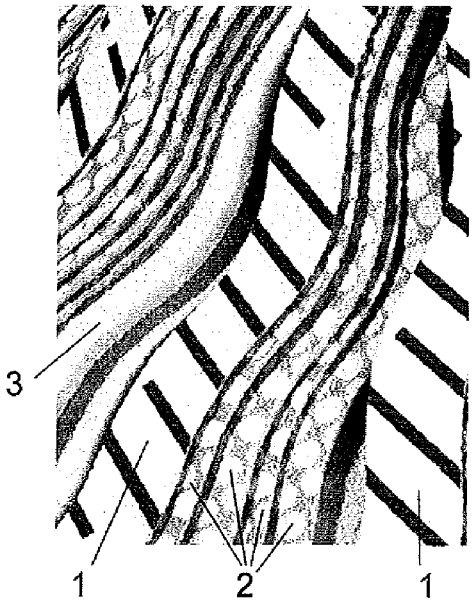
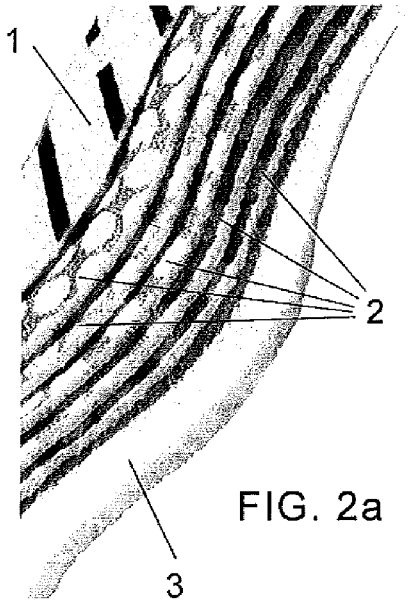
FIG. 2a

CLEANING DEVICE COMPRISING A STRIP MOP WITH STRIPS COVERED WITH MICROFIBER FOR CLEANING FLOORS

BACKGROUND OF THE INVENTION

1. Field of the Invention

The present invention relates to a cleaning device constituted by a cloth with flexible strips connectable to a handle, commonly known with the name "mocio®", hereinafter also called "mop", formed by three groups of strips of different materials, of which one containing strips in microfiber supported by a non-woven fabric.

2. Description of the Related Art

Cleaning cloths with strips are widely used due to the considerable advantages they offer, such as a larger cleaning surface with respect to conventional rectangular cloths, greater practicality of use, easier to wring out, and ability to cover a larger surface in less time. Different types of strip cloths exist on the market according to the material of which the strips are made.

The most commonly used mops are formed by a plurality of flexible strips of the same thickness, each strip being partly divided into fringes. The strips are formed by non-woven fabric and a hot melt layer of microfiber non-woven fabric is glued to the upper portion of the outer surface of the outermost strips, in the area in proximity of the handle. This type of mop is indicated as being capable of exercising 20% more cleaning power with respect to previous mops and also capable of acting on difficult dirt due to the microfiber. The microfiber part is applied by thermal bonding with hot-melt glues on top of the non-woven fabric layer forming the strips.

However, mops of this type have some drawbacks. For example, when the strips are damp or wet, they become heavier forming the classic paintbrush tip, and consequently cover a smaller area with respect to when they are dry. Moreover, thermal bonding of the two different materials is costly from the viewpoint of energy and also due to the use of hot melt glues.

The object of the present invention is to find a mop capable of overcoming the aforesaid drawbacks of prior art providing an improved cleaning and abrasive power in combination with an improved floor covering capacity when the strips of the mop are wet.

A further object is that of providing a mop of this type that is practical, inexpensive and substantially eco-compatible with a lower environmental impact as it derives from recycled and/or recyclable materials.

These and other objects, which will be more apparent hereunder, are achieved in accordance with the invention.

SUMMARY OF THE INVENTION

The cleaning cloth of the present invention is provided with handle and comprises a plurality of non-woven fabric flexible strips, the number and length of which is not binding for the purposes of the present invention.

Said plurality of strips is formed by three distinct groups of strips overlapped with one another: a first group is constituted by the outermost strips, which are flexible and formed by two layers, a lower layer in non-woven fabric and an upper layer in microfiber. As it is known, the term "microfiber" is intended as defining very fine fibers, generally synthetic, having a count equal to or less than 1 dtex (UNI 10714-1999).

Another group, indicated hereinafter also as third group of strips, is constituted by the innermost strips which are provided with greater rigidity with respect to the other strips and are therefore adapted to maintain the bell shape, typical of the dry mop, even after wetting. Said innermost strips are formed by a single layer of non-woven felt with high basis weight, without surface finishing and with greater thickness with respect to the remaining strips placed over said innermost strips. Said third group of strips represents the support for said mop and allows the mop to cover a larger surface with respect to known mops.

Between said outermost strips and said innermost strips there is provided a further group of intermediate strips, flexible and exclusively adapted to absorb water. Said intermediate strips are formed by a single layer of non-woven fabric such as that used in prior art mops, in felt without or in felt with finishing, preferable in non-woven fabric with surface finishing.

BRIEF DESCRIPTION OF THE DRAWING FIGURES

Further characteristics of the invention shall be more apparent from the detailed description below, referring to an embodiment provided purely by way of non-limiting example, illustrated in the accompanying drawings, wherein:

FIG. 1 is an elevated side view of the cleaning cloth in strips, without handle, illustrating the plurality of strips of which it is formed;

FIG. 2 is a partially interrupted enlarged view of a part of the cleaning cloth of FIG. 1;

Figure 3:
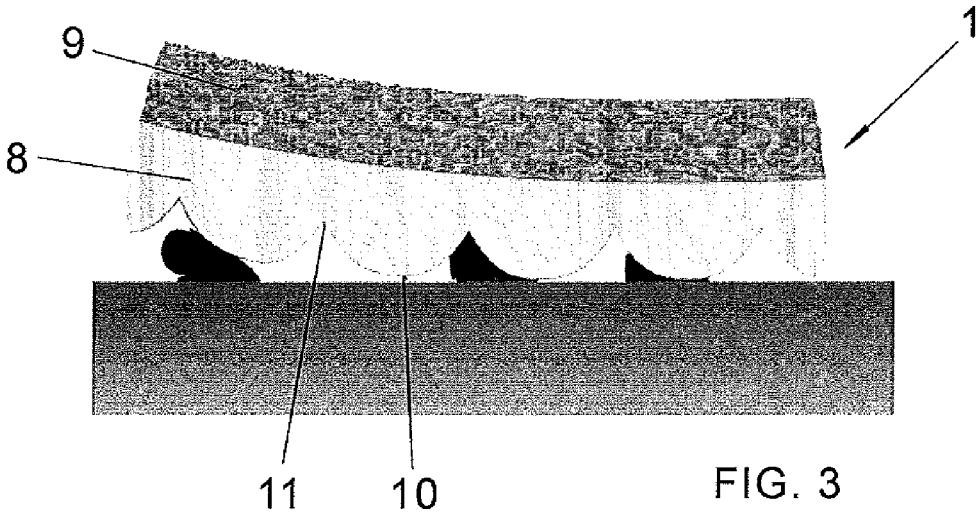
Figure 4:
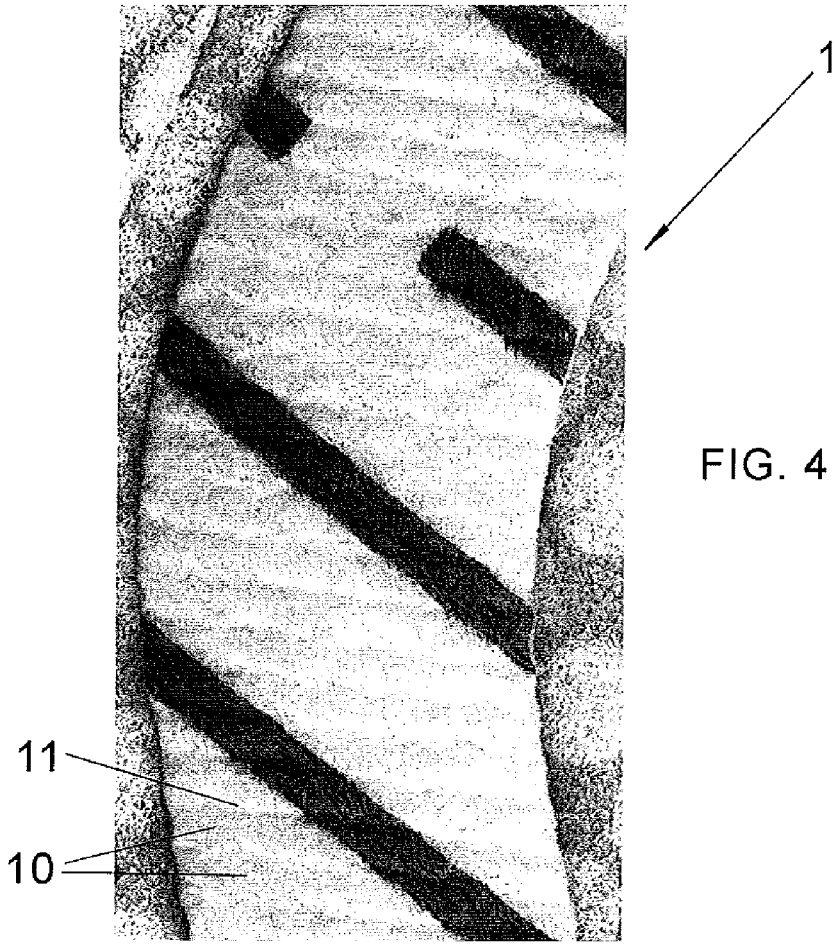

FIG. 2*a* is a partially interrupted enlarged view of overlapped strips of the cleaning cloth of FIG. 1;

FIG. 3 is a partly interrupted greatly enlarged cross section of one of the outermost strips of the cleaning cloth of FIG. 1 in use;

FIG. 4 is an enlarged top plan view of the outer side of one of the outermost strips.

DETAILED DESCRIPTION OF THE INVENTION

With reference to FIGS. 1 and 2, the reference numeral 100 indicates the strip cleaning cloth, or mop, of the present invention without handle, hereinafter also defined as mop "head" 100.

The mop head 100 has a substantially circular profile and is formed by a plurality 200 of flat strips with undulated profile, and flexible, which are constrained to a cap 5.

Said strips are overlapped with profiles coincident and arranged to cover the circumference of the head 100. Said strips 200 are also fixed to the cap 5 and have a free end. Said cap 5 is formed by a base 6 and by a sleeve 7 in which the handle of the mop (not illustrated in the figure) will be inserted, by interlocking or by means of threading or with other fixing means. Said cap 5 also comprises means (not illustrated in the figure) to fix and hold said strips on said cap 5.

The outermost strips of the plurality of strips 200 are indicated in FIG. 1 with the reference numeral 1, and have been visually represented with a surface with transverse strips to distinguish them from the remaining strips underneath.

Said outermost strips 1 are sufficient in number to cover the surface of the bell formed by the plurality of strips 200. In a preferred embodiment said outermost strips 1 are at least twelve.

In FIG. 1 the strips 200 are precisely overlapped with one another so that their respective profiles coincide exactly: however, this is not binding for the purposes of the present invention.

Said strips 1 are formed by two superimposed layers 8 and 9 of non-woven fabric, the layer 8 of which is in microfiber, as illustrated in FIG. 3. The outer surface of said strips 1 that comes into contact with the dirt (illustrated in FIG. 3 with black marks without reference numeral) of the floors, is that of the microfiber layer 8 while the non-woven fabric layer 9 constituted by macrofibers forms the mechanical support for the microfiber layer 8, which can therefore be produced with very low thickness or unit weight. The outer surface of the microfiber layer 8 has embossments or micro-embossments 10 alternated with grooves 11 that generate a rougher surface with "spatula" effect with increased abrasive power that allows more effective removal of dirt (illustrated in FIG. 3 with black marks without reference numeral). The grooves 11 represent the bonding lines between the fibers.

The layer 9 is made with fibers in materials selected, for example, from the group consisting of polypropylene, polyester, cellulose, cotton, viscose, nylon, rayon or a mixture of two or more thereof, and can be spunbonded fibers or staple fiber, preferably made of a 50/50 mixture of polyester and viscose.

The fibers of the microfiber layer 8 can also be constituted by the same materials indicated for the layer 9 but are preferably splittable microfiber formed by an 80/20 mixture of polyester/polyamide. Alternatively, said microfibers can be a mixture of 70% polyester and 30% polyamide.

With regard to the unit weight of the material, that of said layer 9 can vary from 100 to 300 g/m$^2$, preferably 180-280, more preferably 200-250; the unit weight of the layer 8 is instead generally less than or equal to 100 g/m$^2$, preferably less than or equal to 70 g/m$^2$, more preferably comprised between 40 and 70 g/m$^2$, even more preferably 50-60 g/m$^2$.

The outermost strips 1 can have a total thickness comprised between 1 mm and 3 mm, preferably around 2 mm while the thickness of the microfiber layer 8 of the "double layer" bonded fabric can vary from 0.3 mm to 1 mm, preferably around 0.5 mm.

It is also possible for the free side of the layer 9 to have a surface finishing, for example by means of coating with acrylic resins that allow chemical bonding of the fibers.

A second group of central intermediate strips, indicated with the reference numeral 2 and illustrated as having a surface with lozenges, is positioned underneath the outermost strips 1. Said central strips 2 are greater in number with respect to the strips 1 and can also be arranged on several levels in depth towards the center of the bell formed by the plurality 200 of strips, as they have the function of absorbing water.

In a preferred embodiment there are at least sixty of these strips, arranged precisely underneath the twelve outermost strips 1 (twelve strips for each level underneath the outermost strips 1 for a total of five levels).

Said central strips 2 are made of non-woven fabric with fibers deriving from the polymers or polymer mixtures indicated above for the layer 9 of strips 1, preferably made with a mixture composed of 70% regenerated cellulose fibers and 30% recycled PET fibers.

Moreover, said strips 2 can be produced with a thickness comprised between 1.5 and 3 mm, preferably 1.5 mm using said materials having a unit weight comprised between 100 and 300 g/m$^2$, preferably 180-280, more preferably 200-250. The strips 2 can also have a finishing treatment similar to the layer 9 on one or both of the surfaces.

Underneath said central intermediate strips 2, there is a third group of innermost strips identified in FIGS. 1-2*a* with the reference numeral 3 and illustrated with one surface without patterns to distinguish them from the other strips 1 and 2. Said innermost strips 3 are fewer in number with respect to the central strips 2, for example at least twelve arranged on a single level, as their function is essentially that of maintaining the bell shape of the mop even when the remaining strips are wet.

For this purpose, said innermost strips 3 are produced with a greater thickness with respect to the remaining strips 1 and 2, and with a material having a much higher unit weight with respect to the other strips, generally greater than 100 g/m$^2$, preferably comprised between 150 and 400 g/m$^2$.

Moreover, said strips are slightly abrasive, thus contributing towards increasing the abrasive power of the device of the present invention.

These innermost strips 3 are produced with regenerated or recycled materials, such as 100% recycled PET or with a mixture of 70% regenerated cellulose fibers and 30% recycled PET fibers, preferably 100% recycled PET, and with greater thickness with respect to the other two types of strips, generally comprised in the range from 2.5 to 5 mm, preferably 3 mm.

The non-woven textile materials from which the single layer strips 2 and 3 derive are obtained according to prior art techniques.

The textile material of the strips 1 is obtained by means of a process that besides bonding the two different layers 8 and 9 also creates embossments 10 and grooves 11 otherwise called bonding lines. Said process involves needle-punching of a mat formed by at least one layer of carded web of fibers of the lower layer and at least one layer of carded web of microfibers, and the subsequent treatment of the bonded needle-punched mat by means of spunlace/hydroentangled technology with high pressure water jets. Said needle-punching and said treatment with water jets are performed from the same side on the free surface of the microfiber layer 8.

Both needle-punching and spunlace are prior art technologies: in the present process needle-punching is applied only from the microfiber side and the motion of the needles that pass through said mat drive the fibers of the upper microfiber layer between the fibers of the lower layer giving rise to a first bonding between the fibers of the layers. Spunlace bonding with high pressure water jets further bonds the fibers to one another at the same time generating the microfilaments of the microfiber.

In particular, the fibers of the lower layer 9 are fed on a conveyor belt from a first carding system and bonded, while the splittable microfiber fibers of the layer 8 are fed from a second carding system in the form of one or more webs, on top of the free surface of said lower supporting layer 9. This superimposing is followed by the needle-punching operation of the mat formed by the two layers 8 and 9. Then, by means of a device provided with high pressure water jets which are suitably spaced apart from one another, pressure is applied to the surface of the upper layer 8 along the lines of the nozzles which represent the bonding lines or grooves 11 along which the microfibers are bonded to a greater degree with the macrofibers below. In this bonding operation final entanglement of the microfibers occurs, with formation of the cleaning layer 8 fixed to the supporting layer 9, at said longitudinal bonding lines, preferably spaced apart from one another so that they are alternated. Subsequently, the bonded layer thus obtained is air dried and can then be coated with resins for finishing.

Once the materials of the strips have been obtained, the mop of the present invention can be produced according to the following procedure. A plurality of textile materials, equal to or different from one another, but of the same shape, e.g. rectangular, are placed one on top of another on a revolving plate, so as to form a first multi-layer rectangular block in accordance with the sequence of strips 1, 2 and 3 described above, to be obtained in the mop, using as material of the strips 1 the double layer bonded material. Subsequently a second multi-layer rectangular block identical to the first will be placed on top of said first rectangle but staggered by 90° so as to form a cross. Subsequently the cap 5 will be inserted in the center of the rectangle and fixed thereto and then a die press will cut the aforesaid superimposed blocks into strips.

In this way all the strips of the mop of the present invention are constrained, by means of fixing, to the cap 5 on which the handle will then be housed in the same manner as occurs in prior art.

The various layers of rectangular textile materials described above can also be positioned on the revolving plate in a staggered manner, after suitable rotation of the revolving plate so as to form a fan where the outermost strips are staggered with respect to the strips of the level underneath, which in turn are staggered with respect to the strips of the subsequent level underneath, in such a manner as to leave no gaps between the strips.

The strips of said cleaning device according to the invention can have any profile, shape and any length. For example, they can have a rectangular or undulated profile, although they will preferably be produced in flat form and with an undulated contour (profile), with a length comprised between 10 and 40 cm and a width comprised between 5 and 60 mm.

Numerous modifications and variations of detail within the range of those skilled in the art could be made to the present embodiment of the invention, all however falling within the scope of the invention expressed by the appended claims.

The invention claimed is:

1. A cleaning device in a form of a mop connectable to a handle, the cleaning device comprising:

a head with a substantially circular profile formed by a plurality of non-woven loose fabric flexible strips overlapped with one another, the plurality of strips being staggered with respect to one another, and arranged to cover a circumference of the head and to form a bell, wherein the plurality of strips consists of outermost strips, innermost strips, and intermediate strips extending longitudinally along an axis of the handle from a cap for housing the handle, the intermediate strips being arranged on a plurality of levels in depth towards a center of the bell formed by the plurality of strips, the innermost strips of the plurality of strips are abrasive and configured to maintain said bell shape even after wetting of said device, the innermost strips having a greater stiffness and thickness than the remaining strips and being formed by a single layer of non-woven felt with high basis weight, the outermost strips of the plurality of strips are formed by two layers consisting of a microfiber layer bonded to a non-woven fabric supporting layer, and the intermediate strips are formed by a single non-woven fabric layer.

2. The cleaning device according to claim 1, wherein the non-woven material of the innermost strips is 100% recycled PET, the non-woven fabric having a basis weight of at least 100 g/m$^2$.

3. The cleaning device according to claim 1, wherein the microfiber of the microfiber layer is bonded to the non-woven fabric of the microfiber layer by mechanical needle-punching and subsequent treatment with high pressure water jets, adjacent or spaced apart from one another, the needle-punching and the treatment with water jets being performed from the same side on a free surface of the microfiber layer.

4. The cleaning device according to claim 1, wherein an inner surface of the outermost strips is treated by means of surface finishing.

5. The cleaning device according to claim 1, wherein an outer surface of each of the outermost strips has embossments alternated with grooves, the grooves and embossments being obtained by treatment with high pressure water jets spaced apart from one another.

6. The cleaning device according to claim 1, wherein the intermediate strips are positioned underneath the outermost strips and over the innermost strips.

7. The cleaning device according to claim 1, wherein the intermediate strips are constituted by a material selected from polypropylene, polyester, cellulose, cotton, viscose, nylon, rayon or mixtures thereof, in the form of spunbonded fibers or staple fibers.

8. The cleaning device according to claim 1, wherein microfiber of the microfiber layer is splittable and is formed by an 80/20 mixture of polyester/polyamide or has a basis weight of less than or equal to 100 g/m$^2$.

9. The cleaning device according to claim 1, wherein a layer of the non-woven fabric of the outermost strips is constituted by fibers formed by a 50/50 mixture of polyester and viscose, having a basis weight comprised between 100 and 300 g/m$^2$; or the nonwoven fabric of the intermediate strips is constituted by fibers formed by a mixture containing 70% of regenerated cellulose fibers and 30% of recycled PET fibers, having a basis weight comprised between 100 and 300 g/m$^2$.

10. The cleaning device according to claim 1, wherein a thickness of each of the outermost strips ranges from 1 mm to 3 mm and a thickness of the microfiber layer of the outermost strips ranges from 0.3 mm to 1 mm.

11. The cleaning device according to claim 1, wherein fibers of a non-woven fabric supporting the non-woven fabric layer of outermost strips are constituted by a material selected from polypropylene, polyester, cellulose, cotton, viscose, nylon, rayon or mixtures thereof, in the form of spunbonded fibers or staple fibers.

12. The cleaning device according to claim 1, wherein the non-woven fabric of the supporting layer of the outermost strips is constituted by fibers formed by a 50/50 mixture of polyester and viscose, having a basis weight comprised between 100 and 300 g/m$^2$ ; and the nonwoven fabric of the intermediate strips is constituted by fibers formed by a mixture containing 70% of regenerated cellulose fibers and 30% of recycled PET fibers, having a basis weight comprised between 100 and 300 g/m$^2$.

13. The cleaning device according to claim 1, wherein a thickness of the intermediate strips ranges from 1.5 to 3 mm.

14. The cleaning device according to claim 1, wherein a thickness of the innermost strips ranges from 2.5 to 5 mm.

15. The cleaning device according to claim 2, wherein the non-woven fabric has a basis weight between 150 g/m$^2$ and 400 g/m$^2$.

16. The cleaning device according to claim 1, wherein the single layer of non-woven felt of the innermost strips is derived from recycled materials.

17. The cleaning device according to claim 4, wherein the means of surface finishing is by means of coating with acrylic resins.

18. The cleaning device according to claim 6, wherein the single non-woven fabric layer of the intermediate strips has a surface finishing.

19. The cleaning device according to claim 1, wherein microfiber of the microfiber layer is splittable and is formed by an 80/20 mixture of polyester/polyamide and has a basis weight of less than or equal to 100 $g/m^2$.

20. The cleaning device according to claim 1, wherein each of a group of the outermost strips, a group of the innermost strips, and a group of the intermediate strips are loose with respect to each of the other groups.

21. A cleaning device in a form of a mop connectable to a handle, comprising:

a head with a substantially circular profile formed by a plurality of non-woven fabric flexible loose strips overlapped with one another, the plurality of strips being staggered with respect to one another, and arranged to cover a circumference of the head and to form a bell, wherein the plurality of strips consists of outermost strips, innermost strips, and intermediate strips extending longitudinally along an axis of the handle from a cap for housing the handle, the outermost strips are formed by two layers consisting of a first layer of non-woven fabric bonded to a second layer of microfibrous material, the first and second layers comprising material selected from the group consisting of one or more of polypropylene, polyester, cellulose, cotton, viscose, nylon, and rayon, the innermost strips comprising a single layer of non-woven felt with high basis weight, and the intermediate strips being arranged on a plurality of levels in depth towards a center of the bell formed by the plurality of strips, being abrasive, and comprising non-woven fabric selected from the group consisting of one or more of polypropylene, polyester, cellulose, cotton, viscose, nylon, and rayon, the intermediate strips are configured to absorb water, and the innermost strips have a greater stiffness and thickness than the outermost strips and the intermediate strips, the innermost strips being configured to maintain the bell shape after wetting of the device.

* * * * *